US006693395B2

(12) United States Patent
Wilhelm

(10) Patent No.: US 6,693,395 B2
(45) Date of Patent: Feb. 17, 2004

(54) REMOTE CONTROL OF ELECTRONIC LIGHT BALLAST AND OTHER DEVICES

(75) Inventor: William George Wilhelm, Riverhead, NY (US)

(73) Assignee: Nextek Power Systems, Inc., Hauppauge, NY (US)

( * ) Notice: Subject to any disclaimer, the term of this patent is extended or adjusted under 35 U.S.C. 154(b) by 0 days.

(21) Appl. No.: 10/153,522

(22) Filed: May 22, 2002

(65) Prior Publication Data

US 2002/0175637 A1 Nov. 28, 2002

Related U.S. Application Data

(60) Provisional application No. 60/293,707, filed on May 26, 2001.

(51) Int. Cl.[7] ..... G05F 1/00

(52) U.S. Cl. ..... 315/291; 315/307; 315/362; 315/312; 315/316; 315/DIG. 4

(58) Field of Search ..... 315/291, 307, 315/362, 121, 136, 209 R, 312, 316, DIG. 4, DIG. 7, 149, 158; 323/320, 322

(56) References Cited

U.S. PATENT DOCUMENTS

| | | | | | |
|---|---|---|---|---|---|
| 4,149,113 | A | * | 4/1979 | Sammis | 315/219 |
| 4,484,190 | A | * | 11/1984 | Bedard | 340/825.57 |
| 5,111,115 | A | * | 5/1992 | Ball et al. | 315/239 |
| 5,815,067 | A | * | 9/1998 | Knoble et al. | 340/310.01 |
| 5,867,017 | A | * | 2/1999 | Merwin et al. | 323/320 |
| 6,011,682 | A | * | 1/2000 | Storey | 361/117 |
| 6,037,721 | A | * | 3/2000 | Lansing et al. | 315/295 |
| 6,107,755 | A | * | 8/2000 | Katyl et al. | 315/307 |
| 6,528,957 | B1 | * | 3/2003 | Luchaco | 315/307 |

* cited by examiner

*Primary Examiner*—Haissa Philogene
(74) *Attorney, Agent, or Firm*—Alfred M. Walker

(57) ABSTRACT

An electronic ballast system controls one or more ballasts of HID or fluorescent lamps, which are controlled in an "on/off" manner by a ultra low power controller that is isolated for a primary power circuit or derives its very low switch power from the ballast itself. The on/off control provides a near lossless control system. This system may be applied to electronic ballast for operates at fractional power levels corresponding to different lighting intensities and with conventional occupancy sensors. The system may also be applied to other electronically compatible end-use devices and applications.

35 Claims, 5 Drawing Sheets

FIG. 1
(PRIOR ART)
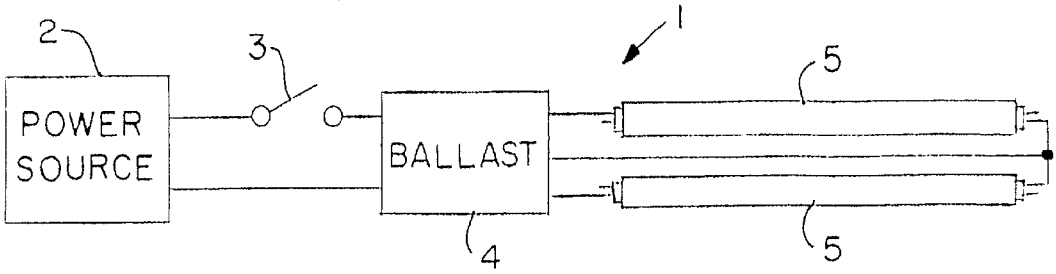
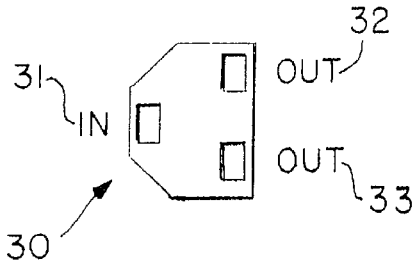
FIG. 3
FIG. 4
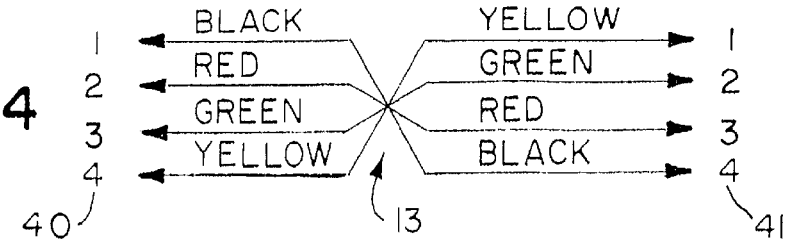
FIG. 5
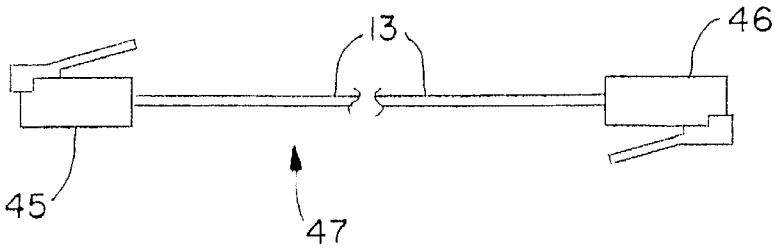

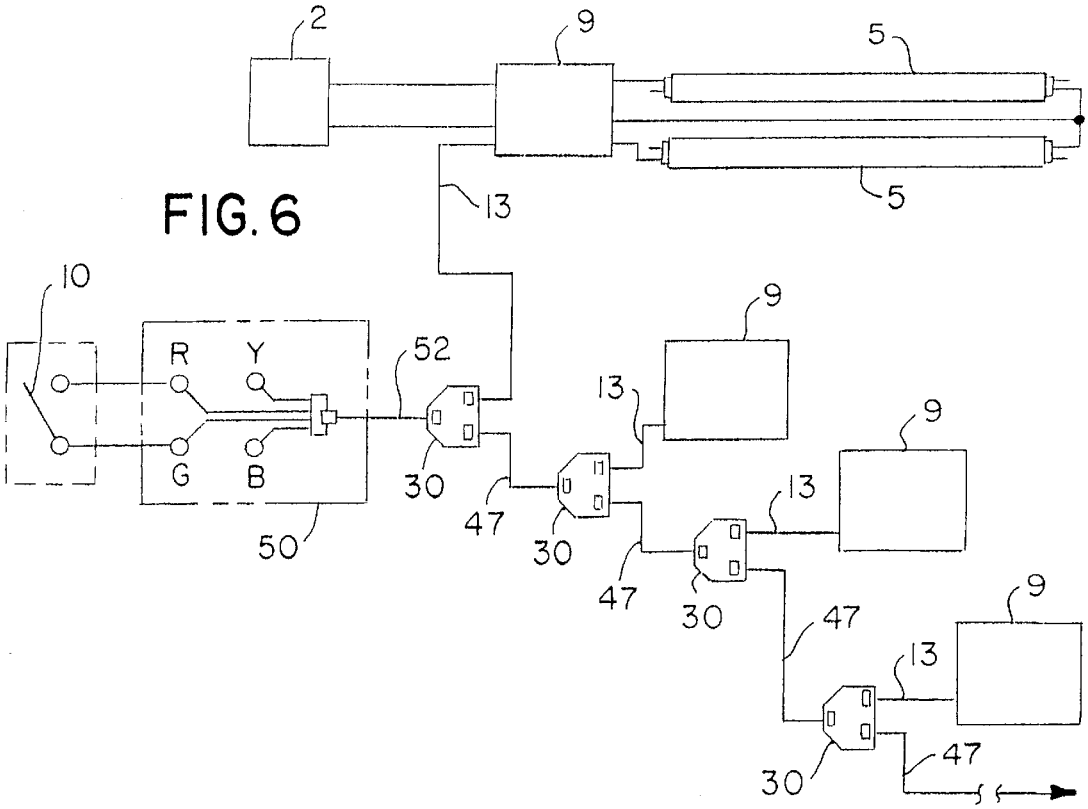
FIG. 6
FIG. 10
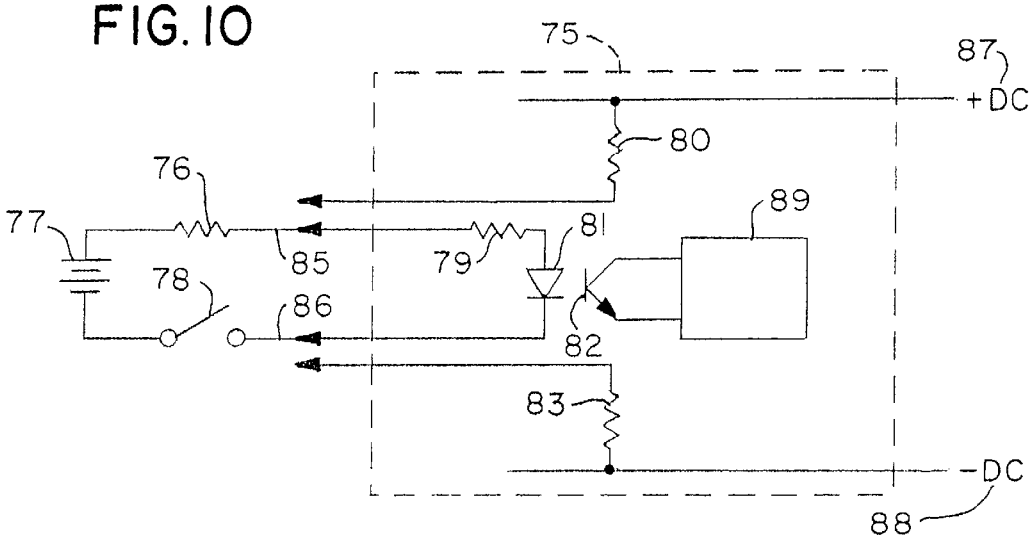

REMOTE CONTROL OF ELECTRONIC LIGHT BALLAST AND OTHER DEVICES

RELATED APPLICATION

This application is based upon U.S. provisional patent application Ser. No. 60/293,707, filed May 26, 2001.

FIELD OF THE INVENTION

The present invention relates to a system and device for low power consumption of on/off control of a single or a plurality of electronic ballasts that can be used for a variety of lighting functions.

BACKGROUND

Electronic ballasting of gas discharge lighting has become the leading option over passive reactive ballasting. Gas discharging lighting includes fluorescent and high intensity discharge (HID) lamps. Electronic ballasts are constructed with active electronic components such as transistors that allow functional electrical control. The normal operation of the ballasted lights requires them to be energized or de-energized corresponding to "on and off" operation. This is usually accomplished by an external mechanical switch, which applies or interrupts electrical power to the ballast and corresponding causes the lamp(s) to go on or off.

The ballast operating current and voltage that powers the ballast must be experienced by this power switch which for safety reasons is under restrictions governed by building code wiring requirements for safety. Because of the special knowledge associated with such power wiring a costly professional electrician is normally required to alter any switching control within a given building space.

There are a number of limitations associated with this common means for on/off control. First the control switch must support the current requirements of all the lighting in a given area, so for large areas, the current carrying capacity of the switch must be raised to accommodate the greater load currents of the lighting. When this happens the power switching arrangement becomes complex with power switching implemented through a combination of mechanical and electric relays (contactors) that increase to hardware needs, increase expense and reduced reliability of the system.

Another limitation occurs if the switch is very remote and distant for the lights, requiring the lighting load current to pass to and from the remote switch causing an undesirable electrical loss corresponding to resistive voltage drops. Additionally, such a system is inflexible to alterations and modifications, essentially requiring the special training and experience of higher cost electric contract service assistance, to alter a switching arrangement, or to add automated remote functions to the lights.

OBJECTS OF THE INVENTION

It is therefore an object of this invention to cause a ballast to be energized in satisfaction of the "on/off" control, by an ultra low power controller that may be essentially isolated for primary power circuit or derive its very low switch power from the ballast itself. With this invention it is possible to effect on/off control with the lowest voltage and current for an essentially near lossless control means. The invention can be used with lighting ballasts, but also for any devices with on/off switches, such as motors, appliances, heaters and the like.

It is also an object of this invention to use its on/off control means to effect other desirable functions in the electric ballast. Such functions include but are not limited to electronic action that would cause the electronic ballast to operate at fractional power levels corresponding to different lighting intensities and/or with conventional occupancy sensors.

It is a further object of this invention to utilize wiring components in the on/off control that correspond to the domain of signal or control wiring and which are characterized by very low power requirements and do not have the restrictions associated with power wiring. Such wiring is common in the telecommunications industry and may be applied to external programmed control.

SUMMARY OF THE INVENTION

In keeping with these objects and others which may become apparent, the present invention is a ballast or power electronics module which is controlled by a remotely located switch function with a low amount of control current and little power loss. This is effected by means of a photo-isolator interfacing circuit within the ballast or within the power electronics module that provides high electrical isolation between an external control signal current and the power electronics of the ballast. The photo-isolator is the switch interface from signal level to power level control.

The on/off switching system can be used for one or more electronic ballasts for one or more lamps, of one or more lighting fixtures. The system includes the one or more ballasts having power electronics, wherein the system further includes a remote switch function in each ballast, which remote switch function is remotely located apart from each ballast. The remote switch function operates with a low amount of control current and little power loss. This on/off switching system further includes one or more connections connecting the remotely located switch to a ballast resident opto-isolator circuit, with associated interfacing electronics within each ballast. Therefore, each ballast provides high electrical isolation between the external switch function and the ballast power electronics to each lamp.

Besides its use with lighting ballasts, the remote on/off switching function system can also be used for one or more electronically interfaceable end-use appliance devices which function through on/off control. For example, the devices can include motors, heaters, appliances, industrial electrical equipment or other appliances which benefit from proportional on/off control as a means for power modulations. In these embodiments for other devices, each device has an on/off switch function, as well as power electronics, wherein the remote switch function is remotely located apart from the device's resident power electronics, wherein further the remote switch function operates with a low amount of control current and little power loss. This on/off switching system further includes one or more connections connecting the remotely located switch function to an opto-isolator circuit with high electrical isolation to the power electronics. The power electronics provides electrical computability between the switch function and the operation of the device.

The remote on/off switching system can be applied for proportional light dimming control having as its interface an optically isolated on/off function interfacing with remote circuitry, providing pulse width modulation to the optically isolated interface control, to cause proportional light dimming. The remote circuitry includes a fixed frequency oscillator influenced by a pulse-width modulator controlled by a voltage setting, wherein proportional pulses cause constant current to flow remotely through a light emitting diode in an optical isolator in the electronic ballast, wherein a constant current driver insures a predetermined proper current to the light emitting diode in compensation for variable cable lengths. A phototransistor/switch of the optical isolator complies with the periodic "on" duty cycle set remotely and causes the power in the ballast circuitry to be applied to the lamp with variable intensity.

A similar on/off switching system can be applied to one or more electrical end-use appliances compatible with electronic on/off control in which a similar optically isolating interface utilizing circuitry influences very low power remote control of power levied in the various end-use appliances such as motor driven devices, electrical heaters, industrial equipment and any other device that might benefit from proportional on/off control as a means for power modulation.

The singular switch can also control a plurality of ballasts including but not limited to ballasts applied to a plurality of HID or fluorescent lamps. This switching function can also be applied to programed interruption such as in controlled blinking functions which are used as an attraction in lighted advertising signs.

Optionally, an external repetitive control may be applied that causes the "on" periods to be different from the "off" period such that power to the lamp is proportional to the on period. The said interface thus becomes a means for dimming with external singular functional control eliminating costly internal dimming control circuitry.

Furthermore, the external remote switch function may be provided through active electronic, such as, in part, a transistor. In addition, the remote switching function can be provided by a programmable electronic system, with or without feedback.

A plurality of lead wires connects the remote switch function, a low current power source, and the light emitting diode (LED) is available at the input of the opto-isolator. The low current power source can be derived from the ballast, or it can be supplied externally.

Although the connectors for the control of the ballast may be any signal type connector, a modular phone jack and plug and the use of the flat 4-conductor cable, common to telephone systems, as the plurality of lead wires facilitates installation.

Through the use of a common four wire 3-way RJ11 telephone coupler at each ballast and a length of flat 4-conductor telephone cable with reversed RJ11 plugs at each end (i.e. a reversed cable net) any number of ballasts can be connected in daisy-chain fashion to be controlled by a single remote switch. Adding, rerouting, or reconfiguring switches to control a network of light fixtures can be accomplished without the need of an electrician.

The electrically isolated photo-transistor portion of the opto-isolator is controlled by light emitted by the LED within the opto-isolator. The state of conduction of its collector-emitter junction is used to electronically control the operation (in an on/off fashion) of any standard high frequency electronic inverter circuitry used to derive AC power of any frequency to the fluorescent or HID lamps.

BRIEF DESCRIPTION OF THE DRAWINGS

The present invention can best be understood in connection with the accompanying drawings, in which:

FIG. 1 is a Prior art block diagram of the common method for switching a lighting ballast;

FIG. 3 is a Top plan schematic view of a common type RJ11 four wire 3-way coupler;

FIG. 4 is a Schematic Contact representation of a reversed 4-wire reversed cable set common to the telephone industry;

FIG. 5 is a Side elevation view of a reversed cable set;

FIG. 6 is a Block diagram of multiple ballast network controlled by one switch;

DETAILED DESCRIPTION OF THE INVENTION

Figure 2:
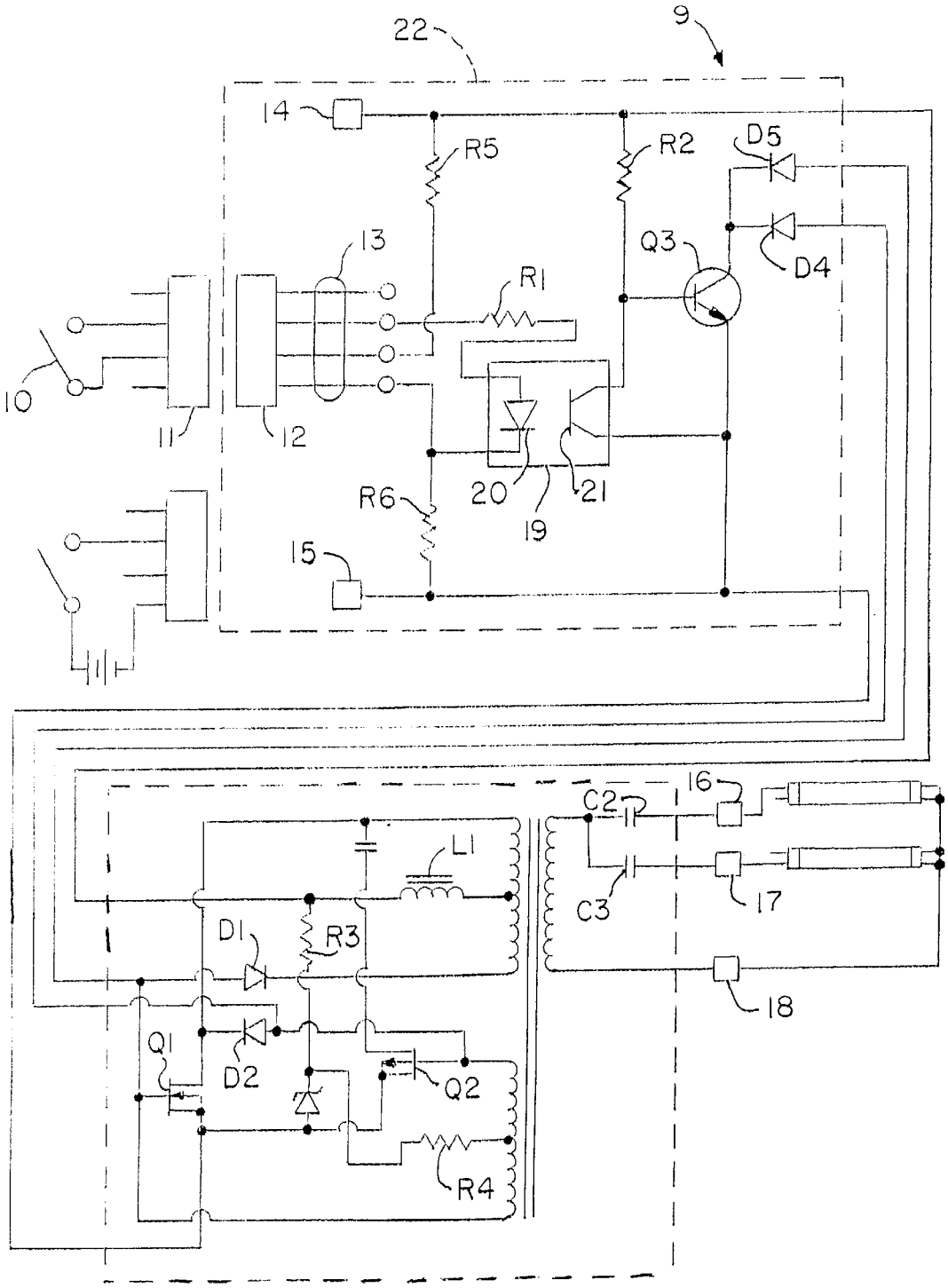
FIG. 2 is a Schematic diagram of an electronic ballast of this invention with optically isolated power control.

A block diagram of a prior art lighting circuit 1 is shown in FIG. 1. A power source 2 is used to power ballast 4 which operates two gas discharge (fluorescent) lamps 5. On/off control of the lamps is influenced by mechanical switch 3 which must be rated for the full supply voltage and current requirements of the lamp load, when multiple ballasts are used in parallel. A long distance from switch 3 to ballast 4 requires evaluation of the effects of the consequent voltage drop. In most jurisdictions, the initial switch wiring as well as any alterations is legally performed only by a licensed electrician.

FIG. 2 is a schematic diagram of an electronic ballast 9 of this invention. A control switch 10 is wired to connector 11. A cable (not shown) connects connector 11 to connector 12; this could be a long distance. A length of flat 4-conductor telephone or any corresponding signal type cable 13 goes from connector 12 to connections within ballast 9. Terminals 14 and 15 supply input power to ballast 9. Output terminals 16 and 17 connect to each of two lamps (not shown.) while connector 18 is common to each of the lamps.

FIG. 2 also shows that the key element that distinguishes this ballast from, other electronic ballasts is the use of an electronic optical isolator component 19 which includes a matched pair of light emitting diode (LED) 20 and photo transistor 21. A internal low voltage and low current supply source for energizing LED 20 may be optionally derived from resistors R5 and R6 which are connected in the ballast internally to the power input supply terminals 14 and 15. When using the internal power source LED 20 is energized when remote switch 10 is closed causing limited power supply current to flow through supply terminals 14 and 15, resistor R1 and LED 20, causing LED 20 to forward bias transistor 21 into conduction. Conducting transistor 21 causes transistor Q3 to stop conducting which reverses biases diodes D1 and D2 conduct, allowing the gates of the transistors in the power oscillator portion of the circuitry 23 in ballast 9 to function in an un-impeded or power "on" mode.

Schematic section 23 (indicated by a dashed line box) serves to typify a standard high frequency inverter circuit used to energize a fluorescent lamp. A similar circuit may be applied to the operation of a HID lamp with emphasis applied to the essential functions of this invention.

Schematic section 22 (indicated also by a dashed line box) is new circuitry related to remote on/off switching, control of one or more ballasts, except for subcircuit 19, which is depicted within the confines of schematic section 22, which is a reverse polarity protector.

Ballast 9 is designed for use with DC power input at terminals 14 and 15.

Reference numeral 19 is a commercial photo-isolator integrated circuit that is capable of providing high electrical isolation between an external control signal and the power electronics in ballast 9.

To turn on ballast 9, a voltage which is either internally generated (as shown) or externally supplied (shown in drawing FIG. 8 herein) is applied to isolator 19 LED 20 and current limited by resistor (R1); light is emitted by LED 20 which excites photo transistor 21 to conduct (i.e.—reduce resistance). This causes current to flow in resistor R2. With resistor R2 and isolator transistor 21 forming a voltage divider, the conducting opto-isolator 19 transistor 21 causes the base-emitter voltage on transistor Q3 to go below conduction, causing the collector-emitter junction on transistor Q3 to become highly resistive (non-conducting). With transistor Q3 non-conducting, there is no current path for diodes D4 and D5 to the power supply return allowing the gates of transistors Q1 and Q2 to remain in a high impedance state and thus unencumbered to function as part of the self-excited power oscillation inverter servicing the gas discharge lamps. A typical example of a transistor, such as transistor Q1 and transistor Q2, is a field effect transistor.

Alternatively, no voltage on the input of opto-isolator 19 reverses the process described above and causes the gates of transistors Q1 and Q2 to be clamped to the potential of the power supply return.

This effectively causes transistors Q1 and Q2 to be placed in a non-conductive state. This action interrupts the power oscillator/inverter causing the lamps to go off.

Thus it can be seen that a low voltage, low current interface controlled by a remotely located wall-mounted switch 10 can be used to control the operation of an electronic ballast to turn lamps on or off. Since each LED 20 just draws a few milliamperes of current, long distance to a remote switch are irrelevant since any voltage drops is insignificant.

While any low voltage connector wire can be used, for convenience and low cost, the use of modular connectors and light weight 4-conductor cable from the telephone industry is part of the preferred embodiment of this invention. For example, FIG. 3 shows a standard telephone RJ11 four wire 3-way coupler 30. This has an input port 31 and two identical output ports 32 and 33 internally wired to maintain terminal correspondence for each of the four terminals in each port.

Cable 13 spans between cable end connectors 45 and 46, forming together reversed cable 47 of FIG. 5. Reversed cable 47 includes flat four wire cable 13 with opposing end connectors 45 and 46, wired as shown in FIG. 4, such that reference numerals 40 and 41 refer to the physical order of the respective colored wire connections 40 in cable end connector 45, and to the reversed order of colored wire connections 41 in cable end connector 46, of reversed cable 47 of FIG. 5. For example, FIG. 4 shows the configurations of opposite end contact wire connections 40 and 41 of the four colored wires of reversed cable 47, labeled "Black", "Red", "Green" and "Yellow", such that the physical order shown at contact connections 40 is used in cable end connector 45, whereas the reversed order shown at contact connections 41, labeled "Yellow", "Green", "Red" and "Black", is used in cable end connector 46. Other wire patterns can be used.

The reversed cable 47 is shown in FIG. 5 (a reversing telephone cable is common and used here, but is not required to effect this invention) while the terminal wiring is shown schematically in FIG. 4. The RJ11 cable end connectors 45 and 46 are attached to four wire cable 13 in opposite orientation (see FIG. 5) to maintain the conductor/terminal integrity shown in FIG. 4.

FIG. 6 shows a wiring diagram of multiple ballasts 9 controlled by a single remote switch 10. A modular phone plate 50 is locally wired to wall switch 10 which attaches to the red and green wires. A long cable 52 with RJ11 cable end connectors attaches phone plate 50 to the first 3-way coupler 30. Short single-ended cable 13 plugs into either output port of coupler 30 while the other end is hard wired to ballast 9 as shown in FIG. 2. The other output port of coupler 30 is used to connect to a second ballast through reversed cable 47 and a second coupler 30 as shown.

Additional ballasts are similarly added in "daisy-chain" fashion as shown in FIG. 6. The network is extendable to a large number of individual ballasts since the only load experienced by switch 10 and long cable 52 is that of the parallel load of the LED's 20 in each of the opto-isolators 19 in each ballast 9. In this manner, 3-way couplers 30 in the vicinity of each ballast are used as extension elements to create an easy connection to the next ballast in the chain.

Figure 7:
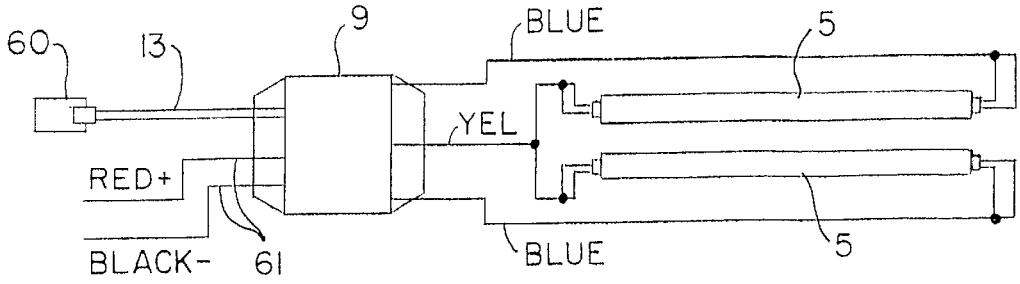
FIG. 7 is a physical layout of a electronic ballast with electrical connection for this invention.

FIG. 7 shows a physical layout of a lighting fixture using ballast 9 powering lamps 5. Short single-ended cable 13 with RJ-11 connector 60 extends from the housing of ballast 9; red and black power input leads 61 also extend from ballast 9. As shown in FIG. 6, cable 13 is plugged into 3-way coupler 30 via RJ-11 connector 60.

Figure 8:
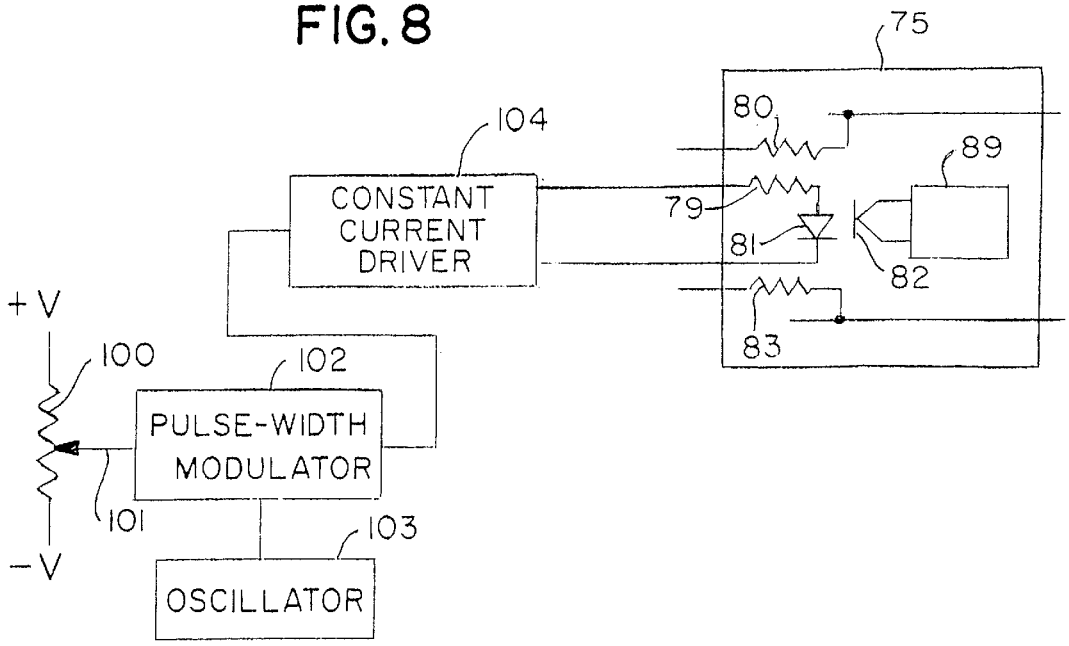
FIG. 8 is a block diagram of an alternate embodiment offering remote proportional dimming of a simple low cost electronic ballast using the on/off optically isolated interface embodied in the invention.

The block diagram of FIG. 8 is an alternate embodiment utilizing the enhanced electronic ballast 9 of FIG. 2 with the optically isolated ON/OFF control interfacing with remote circuitry providing pulse width modulation to the optically isolated ballast interface for proportional dimming control. FIG. 8 also shows a device 75 controlled by circuitry of FIG. 10.

A fixed frequency oscillator 103 feeds pulse-width modulator 102 which is controlled by a voltage setting provided by the wiper 101 on potentiometer 100.

By varying the setting, duty cycles from close to 0% to almost 100% can be derived. These pulses are fed to constant current driver 104 which interfaces remotely with the light emitting diode in optical isolator 19 which is part of electronic ballast 9. This is the same optical isolator that is used for the remote ON/OFF control described previously.

Constant current driver 104 for a series connected control system insures the proper current to the remote ballast interface 19 and any voltage drops in the long control cable. The phototransistor output of optical isolator 19 then complies with the duty cycle set remotely and varies the average power to the ballast circuitry resulting in proportional changes in light intensity.

Figure 9:
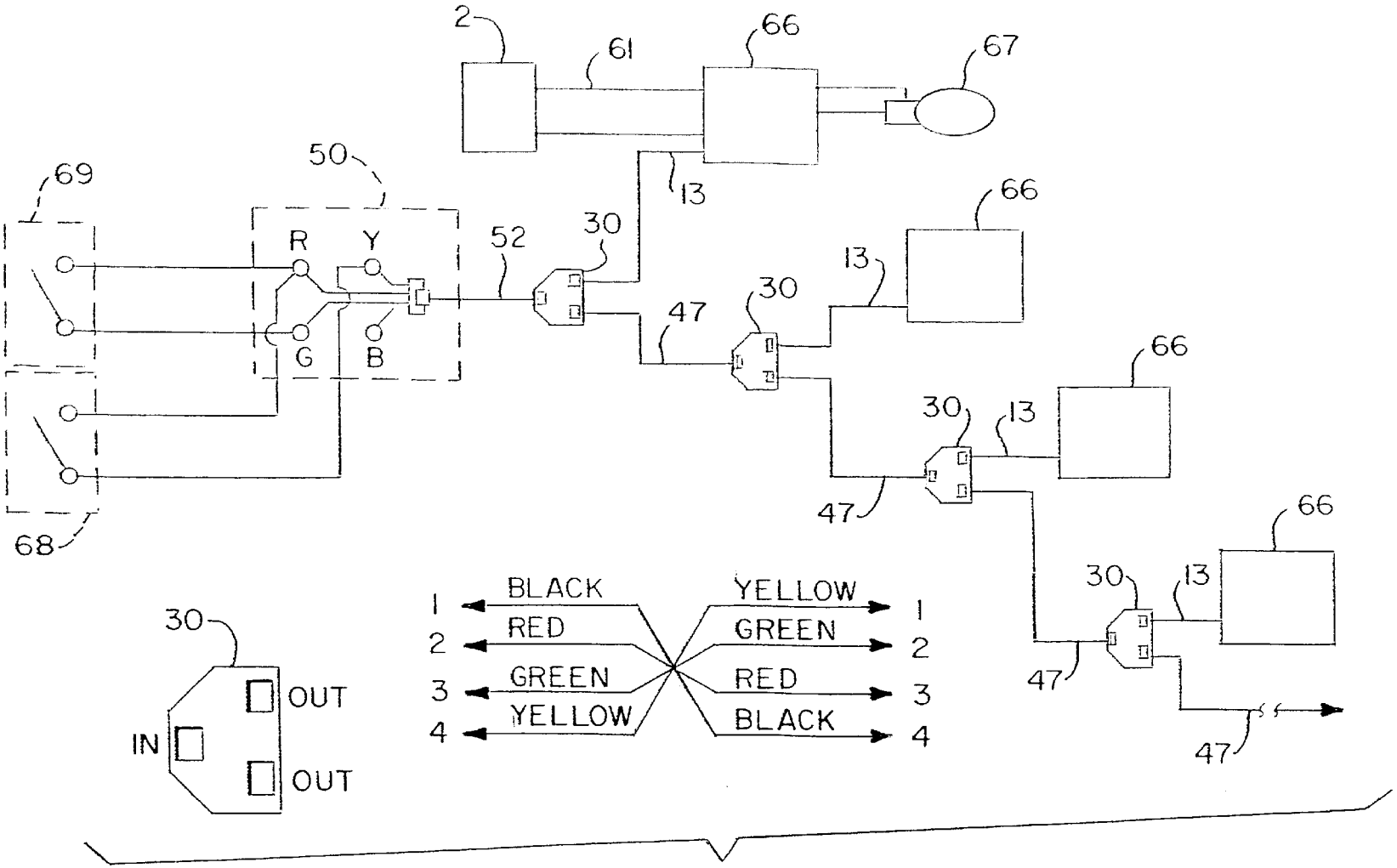
FIG. 9 is a block diagram showing use of low power external ballast control for on/off control and bi-level HID dimming functions, showing the control cabling with RJ11 connectors; and, FIG. 10 shows a block diagram of a fully isolated remote switch.

FIG. 9 shows the wiring of a network of ballasts 66. In this case, switch 68 is used for dimming and switch 69 is used for on/off control while utilizing the same 4-wire signal cable system.

FIG. 10 shows a block diagram of a fully isolated remote switch 78 with remote battery 77 and remote current limiting resistor 76 selectively supplying power to control a device 75 with function 84 therein. Long low power/voltage cables 85 and 86 operate light emitting diode (LED) 81 through further current limiting resistor 79. Resistor 76 maybe substituted with any electronic current limiting means. Phototransistor 82 is controlled by light from LED 81 into either a conducting or non-conducting state to control function 84. Device 75 is supplied with DC power by positive (+) terminal 87 and negative (–) terminal 88. Current limiting resistors 80 and 83 may be used to support any low power remote equipment (not shown) which may not require totally isolated power.

It is further noted that other modifications may be made to the present invention, without departing from the scope of the invention, as noted in the appended claims.

I claim:

1. The A system of at least one of on/off switching and dimming for at least one electronic ballast for at least one lamp, of at least one lighting fixture, said system comprising said at least one ballast having power electronics, said system further having a remote switch function in said at least one ballast, said remote switch function remotely located apart from said ballast, said remote switch function operating with a low amount of control current and little power loss, said system of at least one of on/off switching and dimming further comprising at least one connection connecting said remotely located switch to a ballast resident opto-isolator circuit with associated interfacing electronics within said at least one ballast, said at least one ballast providing high electrical isolation between an external switch function and said ballast power electronics to each said lamp;

said system of at least one of on/off switching and dimming further comprising a plurality of lead wires connecting said remote switch, a low current power source, and a light emitting diode (LED) at an input of said isolator circuit.

2. The system of at least one of on/off switching and dimming as in claim 1 wherein said remote switch is a fully isolated remote switch.

3. The system of at least one of on/off switching and dimming as in claim 1 wherein a current power source sufficient to operate external electronics is derived from said at least one ballast.

4. The system of at least one of on/off switching and dimming as in claim 1 wherein a current power source sufficient to operate external electronics of said ballast is supplied externally.

5. The system of at least one of on/off switching and dimming according to claim 1, wherein said connection is a modular phone connector, and said plurality of lead wires are telephone wire.

6. The system of at least one of on/off switching and dimming according to claim 1, wherein said plurality of lead wires are any, low voltage, signal grade or larger wire common to control systems.

7. The system of at least one of on/off switching and dimming as in claim 5 wherein said telephone wire is a flat multi-conductor cable.

8. The system of at least one of on/off switching and dimming as in claim 1 wherein said at least one ballast is a plurality of ballasts of a plurality of light fixtures, each said light fixture having at least one lamp, each said ballast being connected by a multi-way coupler at each ballast and a plurality of multi-conductor cables, one said cable having reversed connectors at each end connecting an output of said multi-way coupler to the input of the next said multi-way coupler, wherein said plurality of ballasts are connected in cascade configuration to said single remote switch such that all connected ballasts of said plurality of ballasts respond to on/off switching action of said remote switch.

9. The system of at least one of on/off switching and dimming as in claim 1 wherein an isolated photo-transistor portion of said opto-isolator circuit is controlled by light emitted by a light emitting diode (LED) within said opto-isolator.

10. The System of at least one of on/off switching and dimming as in claim 9 further comprising a collector-emitter junction controlling on/off operation of a high frequency inverter circuit used to provide AC power to each said lamp of each said lighting fixture.

11. A The system of at least one of on/off switching and dimming according to claim 1, wherein said system of at least one of on/off switching and dimming is applied to a blinking function used as an attraction in lighted effects.

12. The system of at least one of on/off switching and dimming according to claim 1, in which an external on/off function is controlled to switch rapidly and with a proportional on time that is proportional to a controlled power level.

13. The system of at least one of on/off switching and dimming according to claim 1, in which the external switch function is provided by an electronic type switching arrangement.

14. The system of at least one of on/off switching and dimming according to claim 13, wherein said electronic switching arrangement includes at least one transistor.

15. The System of at least one of on/off switching and dimming according to claim 1, in which external switch function is provided by an electronic system that is programmable.

16. A system of at least one of on/off switching and dimming for a plurality of electrical lighting fixtures comprising:

a control switch:

a connector having a first end connected to said control switch and said connector having a second end;

a plurality of lead wires wherein each said lead wire in said plurality of lead wire has a first end and a second end, said first end of each said wire in said plurality of lead wires is coupled to said second end of said connector;

said plurality of lead wires has a first lead wire coupled to a first end of a first resistor;

a second end of said first resistor is connected to a photo-isolator circuit, said photoisolator circuit providing high electrical isolation between an external control signal and power electronics of at least one electronic ballast;

said plurality of lead wires has a second lead wire coupled to a first end of a second resistor;

a second end of said second resistor is coupled to a first direct current power input terminal and a first end of a reverse polarity protector circuit;

said first end of said reverse polarity protector is coupled to a first end of a third resistor and to a high frequency inverter circuit, and said high frequency inverter circuit has a second end coupled to a second direct power input terminal;

a second end of said third resistor is coupled to a base terminal on a transistor and to said photo-isolator circuit;

an emitter terminal on said transistor is coupled to said photo-isolator circuit and to said second direct current power input terminal;

a collector terminal on said transistor is coupled to a cathode terminal of a first diode and to a cathode terminal of a second diode;

said first diode and said second diode each having an anode terminal coupled to said high frequency inverter circuit;

a third lead wire in said plurality of lead wires is coupled to a first end of a fourth resistor and to said photo-isolator circuit;

said fourth resistor having a second end coupled to said second direct current power input terminal;

said high frequency inverter circuit has at least one output terminal and a ground terminal; and, each output terminal in said at least one output terminal is coupled to a lamp.

17. The system of at least one of on/off switching and dimming according to claim 16, wherein said connector is a modular phone jack, and said plurality of lead wires are telephone wire.

18. The system of at least one of on/off switching and dimming system according to claim 16, wherein said plurality of lead wires are low voltage wire common to control systems.

19. The system of at least one of on/off switching and dimming according to claim 16, wherein said photo-isolator circuit comprises:

an anode terminal of a light emitting diode coupled to said second end of said first resistor and a cathode terminal of said light emitting diode coupled to said first end of said fourth resistor; a collector terminal of a photo-transistor coupled to said base terminal of said first transistor and to said second end of said third resistor; and an emitter terminal of said photo-transistor is coupled to said emitter terminal of said first transistor, said second end of said reverse polarity protector, said second end of said fourth resistor, and said second direct current input terminal.

20. A system for at least one of on/off switching function and dimming for at least one electronically interfaceable end-use appliance device which functions through on/off control, said device having an on/off switch function, said system having power electronics, said system further having a remote switch function, said remote switch function remotely located apart from said device resident power electronics, said remote switch function operating with a low amount of control current and little power loss, said system of at least one of on/off switching and dimming further comprising at least one connection connecting said remotely located switch function to an opto-isolator circuit with high electrical isolation to said power electronics said power electronics providing electrical computability between said switch function and the operation of said device, wherein said device or appliance benefits from proportional on/off control as a means for power modulations.

21. The system of at least of on/off switching and dimming as in claim 20 wherein an isolated photo-transistor portion of said opto-isolator circuit is controlled by light emitted by a light emitting diode (LED) within said opto-isolator.

22. The system of at least one of on/off switching and dimming as in claim 21 further comprising a collector-emitter junction controlling on/off operation of a high frequency inverter circuit used to provide AC power to each said device.

23. The system of at least one of on/off switching and dimming as in claim 1 wherein said device is a motor driven appliance.

24. The system of at least one of on/off switching and dimming as in claim 20 wherein said device is a electrical heater.

25. The system of at least one of on/off switching and dimming as in claim 20 wherein said device is industrial control equipment.

26. The system of at least one of on/off switching and dimming as in claim 20 further comprising a plurality of lead wires connecting said remote switch, a low current power source and a light emitting diode (LED) at an input of said opto-isolator circuit.

27. The system of at least one of on/off switching and dimming eye-tern as in claim 26 wherein a current power source sufficient to operate external electronics is supplied externally.

28. The system of at least one of on/off switching and dimming as in claim 26 wherein a current power source sufficient to operate external electronics is derived from said power input of said power electronics module.

29. The system of at least one of on/off switching and dimming according to claim 26 wherein said connection is a modular phone connector, and said plurality of lead wires are telephone wire.

30. The system of at least on of on/off switching and dimming as in claim 29 wherein said telephone wire is a flat multi-conductor cable.

31. The system of at least one of on/of if switching and dimming according to claim 29, wherein said plurality of lead wires are any, low voltage, signal grade or larger wire common to control systems.

32. A system of at least one of on/off switching and dimming for a plurality of ballasts for a plurality of electrical lighting fixtures comprising:

a photo-isolator integrated circuit providing high electrical isolation between an external control signal and power electronics in at least one ballast;

wherein, to turn on said at least one ballast, a power source supplies voltage to said isolator circuit through a remote switch, said circuit having a light from an LED exciting a photo transistor reducing its equivalent resistance into conduction thereby, causing a higher current to flow in a resistor, said resistor and said photo transistor forming a voltage divider, said voltage divider causing a base-emitter voltage of a control transistor to tall below conduction, causing its collector-emitter junction to become highly resistive and non-conducting, thus blocking a current path for diodes to a power supply return and allowing inverter gates to remain in a high impedance state and thus unencumbered to function as part of a self-excited power oscillation inverter servicing at least one lamp driven by said at least one ballast, wherein further when no voltage is applied on an input of said isolator, said gates are clamped to a potential of a return of said power supply, causing said gates to be placed in a non-conductive state, thereby interrupting said power oscillator/inverter and causing said at least one lamp driven by said at least one ballast to go off.

33. An on/off switching function system for at least one electronically interfaceable end-use appliance device which functions through on/off if control, said device having an on/off switch function, said system having power electronics, said system further having a remote switch function, said remote switch function remotely located apart from said device resident power electronics, said remote switch function operating with a low amount of control current and little power loss, said system of at least one of on/off switching and dimming further comprising at least one connection connecting said remotely located switch function to an opto-isolator circuit with high electrical isolation to said power electronics said power electronics providing electrical computability between said switch function and the operation of said device, wherein said connection is a modular phone connector, and said plurality of lead wires are telephone wire;

wherein said telephone wire is a flat multi-conductor cable;

wherein said at least one device is a plurality of devices, each said device being connected by a multi-way coupler at each device and a plurality of said flat multi-conductor cables, one said cable having reversed connectors at each end connecting an output of said multi-way coupler to the input of the next said multi-way coupler, wherein said plurality of devices with said power electronics are connected in cascade configuration to said single remote switch function such that all connected devices of said plurality of devices respond to on/off switching action of said remote switch function.

34. An on/off switching function system applied with proportional light dimming control, said proportional light dimming control system having as its interface a system comprising said at least one ballast having power electronics, said system further having a remote switch function in said at least one ballast, said remote switch function remotely located apart from said ballast, said remote switch function operating with a low amount of control current and little power loss, said system of at least one of on/off switching and dimming further comprising at least one connection connecting said remotely located switch to a ballast resident opto-isolator circuit with associated interfacing electronics within said at least one ballast, said at least one ballast providing high electrical isolation between an external switch function and said ballast power electronics to each said lamp;

said proportional light dimming control system an electronic ballast having an isolated on/off function interfacing with remote circuitry providing pulse width modulation to said isolated interface control to cause proportional light dimming, said remote circuitry including a fixed frequency oscillator influenced by a pulse-width modulator controlled by a voltage setting, wherein proportional pulses cause constant current to flaw remotely through a light emitting diode in an optical isolator in said electronic ballast, a constant current driver insuring a predetermined proper current to said light emitting diode in compensation for variable cable lengths, wherein a phototransistor/switch of said optical isolator complies with the periodic "on" duty cycle set remotely and causes the power in said ballast circiutry to be applied to the lamp with variable intensity.

35. An on/off switching system applied to at least one electrical end-use appliance device compatible with electronic control said device having an on/off switch function, said system having power electronics, said system further having a remote switch function, said remote switch function remotely located apart from said device resident power electronics, said remote switch function operating with a low amount of control current and little power loss, said system of at least one of on/off switching and dimming further comprising at least one connection connecting said remotely located switch function to a opto-isolator circuit with high electronical isolation to said power electronics, said power electronics providing electrical computability between said switch function and the operation of said device, in which an optically isolating interface utilizes circuitry providing pulse width modulation to said optically isolated interface to cause proportional on/off control, said circuitry including a fixed frequency oscillator influenced by a pulse-width modulator controlled by a voltage setting, wherein proportional pulses cause constant current to flow remotely through a light emitting diode in an optical isolator in power electronics, said constant current driver insuring a predetermined proper current to said light emitting diode in compensation for variable cable lengths, wherein a phototransistor/switch of said optical isolator complies with the periodic "on" duty cycle set remotely and causes the power in said circuitry to be applied to said end use appliance device with variable intensity, said proportional on/off control system permitting very low power remote control of power consumed by various end-use benefiting from proportional on/off control as a means for power modulation.

* * * * *